United States Patent [19]

Heinrich

[11] Patent Number: 5,036,589

[45] Date of Patent: Aug. 6, 1991

[54] SELF PROTECTIVE DEVICE UTILIZING AN ARTIFICIAL NAIL

[76] Inventor: Robert G. Heinrich, 8303 Chianti Ct., San Jose, Calif. 95135

[21] Appl. No.: 488,113

[22] Filed: Mar. 5, 1990

[51] Int. Cl.[5] ..... B26B 27/00

[52] U.S. Cl. ..... 30/298; 132/73; 606/125

[58] Field of Search ..... 30/296.1, 298; 132/73; 606/125, 167, 185; 7/121

[56] References Cited

U.S. PATENT DOCUMENTS 3,749,099 7/1973 Cotey ..... 606/125

*Primary Examiner*—Douglas D. Watts

*Attorney, Agent, or Firm*—Lloyd F. Seebach

[57] ABSTRACT

The invention relates to a device which is utilized to identify an assailant. The device comprises a member simulating an artificial nail or an artificial nail having at least one sharp prong associated therewith for penetrating or scratching the skin of the assailant when sufficient pressure is applied thereto by the finger. A substance in dry, liquid or dehydrated form that is capable of identifying the assailant or providing an itching or burning sensation is carried by the prong. When pressure is applied to the device by the finger on which the device is mounted and is sufficient to pierce or scratch any exposed skin area of the assailant, the substance is then introduced into the blood stream of the assailant, thereby effectively thwarting the action of the assailant.

4 Claims, 1 Drawing Sheet

SELF PROTECTIVE DEVICE UTILIZING AN ARTIFICIAL NAIL

FIELD OF THE INVENTION

The present invention relates to a self-protective device utilizing a member separate from or a part of an artifical nail and, more particularly, to a device by which the user can effectively place an identifying mark on, immobilize or ward off an assailant.

DESCRIPTION OF THE PRIOR ART

A search of the prior art revealed a number of U.S. Patents in which various devices are disclosed for puncturing or penetrating the skin of a person to introduce a vaccine into the person's bloodstream. Such devices, generally, are used in connection with a vaccination for smallpox and the like to obtain as uniform and as small a scar as possible.

In U.S. Pat. No. 3,062,212, a thumb-actuated vaccinator is disclosed which provides for preloading the vaccine onto a plurality of prongs associated with the device prior to effecting the actual vaccination operation, the vaccine being in liquid, dry or dehydrated form. This device is disclosed as also being useful for various other types of tests, for example, tuberculin, virus, BCG innoculations and so forth. Other U.S. Pat. Nos., such as, 2,817,336, 2,893,392, 2,974,787, 3,072,122 and 3,136,314, disclose similar devices in which skin penetrating prongs are utilized as carriers of medication for introduction into the bloodstream of a person when sufficient pressure is applied to the device so the prongs will penetrate or scratch the skin.

With respect to artificial nails per se, U.S. Pat. Nos. D295,451, 2,073,867, 3,037,514, 3,478,756, 3,502,088, 3,552,401, 4,157,095 and 4,511,608 disclose various ways in which an artificial nail can be structured, formed and adhered to a natural nail. In this prior art, the primary result that is sought is one of cosmetics, that is, to improve the appearance of the natural nails by adhering an artificial nail to each individual nail, thereby providing nails of uniform length and shape or to repair any natural nail individually in order to maintain that nail in uniform shape and length with the other nails on the fingers. Although the prior art noted hereinabove may disclose some elements of the present invention, generally speaking, there is no suggestion nor disclosure of a nail structured for use as a self-protective device as described and disclosed hereinafter.

SUMMARY OF THE INVENTION

The object of the present invention is to provide a self-protective device for use by a person against an attack by an assailant that is immediately available for use at the instant of such attack.

Another object of the invention is to provide a self-protective device for use by a person against an attack by an assailant that can be releasably secured to the end of a finger or is part of one or more nails on either or both hands of the person to introduce an identifying substance into the bloodstream of the assailant.

Still another object of the invention is to provide a self-protective device for use by a person against an attack by an assailant that is releasably secured to the end of a finger or to one or more of the natural nails of the person and is provided with a sharp prong which carries an identifying substance to be introduced into the bloodstream of the assailant when the skin is scratched or punctured by the prong.

And yet another object of the invention is to provide a self-protective device for use by a person against an attack by an assailant that is releasably secured to the end of a finger or to one or more of the natural nails of the person and is provided with a sharp prong which carries a liquid, dry or dehydrated form of identifying substance for instant introduction into the bloodstream of the assailant when the skin is scratched or punctured by the prong.

These and other objects of the invention will be apparent to those skilled in the art by the description which follows.

With various types of personal crimes, such as mugging, assault and rape being committed against men and women of all ages, it is apparent that means must be provided to alleviate or at least reduce these crimes. One attempt in this direction was the introduction of Mace, an aerosol chemical which can be directed as a mist into the face of an assailant. The drawback to this form of self-protection is that the receptacle unless carried in hand, must be taken from a pocket or purse before it can be used and, usually, the element of surprise is lost because of the time required for bringing the Mace receptable into play. Further, the supposition of attack cannot be presumed. As a result, the element of surprise is usually to the advantage of the assailant rather than the victim. To offset this disadvantage, the victim must have something immediately available and at his or her very fingertips.

Briefly, the invention comprises a device which can be releasably secured to the end of a finger, to a natural nail or to an artificial nail either by mechanical of adhering means. In one embodiment of the invention an artificial nail that is releasably secured to the natural nail and extends beyond the end of the natural nail is provided with a sharp prong in the portion thereof beyond the end of the natural nail. Preferably before the artificial nail is secured to the natural nail, a dry, liquid or dehydrated form of identifying substance is applied to the extending prong. Such a nail need be adhered or secured to only one finger, namely, the first or middle finger, whichever the person feels will best supply the pressure needed to scratch or puncture the skin of the assailant. If under attack, the finger with the pronged artificial nail needs to be moved into contact with the assailant's skin with sufficient pressure to scratch or puncture the skin so as to introduce the identifying substance into the assailant's bloodstream.

DESCRIPTION OF THE DRAWING

Reference is now made to the accompanying drawing wherein like reference numerals and characters designate like parts and wherein.

DESCRIPTION OF PREFERRED EMBODIMENTS

Figure 1:
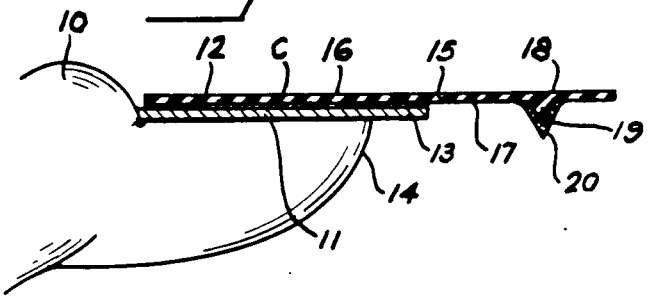
FIG. 1 is a side elevation, partially in section, of a fingertip showing an artificial nail provided with a prong and secured to the exposed surface of the natural nail.
Figure 2:
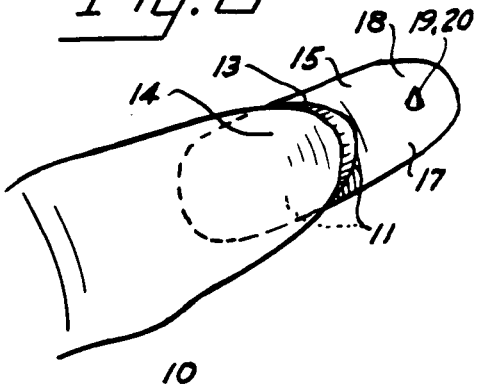
FIG. 2 is a bottom view of the fingertip shown in FIG. 1 disclosing the relation of the free end of the artifical nail and the prong to the free end of the natural nail.
Figure 3:
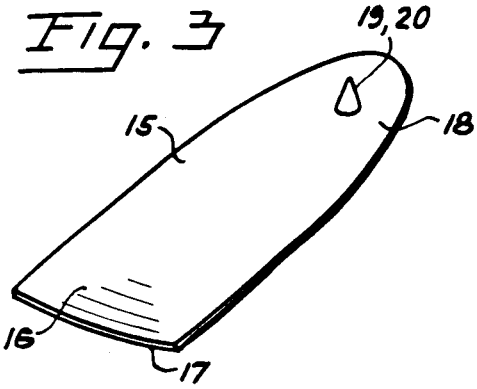
FIG. 3 is a perspective view showing the underside of the artificial nail shown in FIG. 1 and the prong projecting from the extending portion associated therewith.

With reference to FIGS. 1, 2 and 3, a fingertip 10 has a natural nail 11 with an exposed upper or outer surface 12. Usually, a free end 13 of the natural nail 11 extends beyond the end 14 of the fingertip 10.

The use of an artificial nail 15 is generally utilized to simulate the natural nail 11 in order to present a better appearing and more uniform nail. The artificial nail can be blanked from a sheet of thermoplastic synthetic polymer resin containing plasticizers, if needed, and coloring agents, if desired. The blank can be formed with a convex upper or outer surface and a concave under surface conforming generally to the upper or outer surface 12 of the natural nail 11.

In applying an artificial nail that has been formulated and molded to approximate a natural nail, the artificial nail structure is oriented to be congruent with the natural nail. The natural nail is usually coated beforehand with a solvent cement C which can comprise the same or similar ingredients as the artificial nail or be merely a carrier obtaining protein and thickeners. The artificial nail 15 is then pressed into place against the cement coating. The solvent present in the cement solubilizes the carrier at the concave undersurface.

As seen in FIGS. 1, 2 and 3, the artificial nail 15 comprises a convex upper or outer surface 16 and a concave undersurface 17 conforming generally to the exposed upper surface 12 of the natural nail 11. A portion 18 of the artificial nail extends beyond the end 13 of the natural nail 11. In the portion 18 a sharp prong 19 is molded integral with the artificial nail 11 and extends from the undersurface 17.

Before or after the artificial nail 15 is secured to the natural nail 11, an identifying substance 20 can be applied to the prong 19. The artificial nail 15 is secured to the natural nail 11 when the person, male or female, has reason to believe that the errand or area through which he or she must pass is or has been subject to muggings, assaults and so forth, and a measure of protection is deemed to be necessary. While the medicated or treated artificial nail can be placed on any one of the fingers on either hand, preferably it should be placed on the strongest finger which is usually the forefinger of the right hand of a right-handed person or vice versa. Actually, there is no need to place a protective artificial nail 11 on more than one finger. If attacked by an assailant for any reason at least one area of the face, neck, hands and possibly the forearms of the assailant are usually exposed and uncovered. The person being attacked can quickly notice such exposed areas and try to scratch or puncture the skin of the assailant in one of these areas with the finger having the artificial nail 15 with the prong 19 attached thereto.

The identifying substance 20 which is applied to the prong 19 can be dry, liquid or dehydrated. Such an identifying substance can be an indelible ink, a form of tranquilizer, such as used on animals by veterinarians, or a substance which will provide a pronounced burning or itching sensation sufficient to deter any further action by the assailant. While the tranquilizer, of course, would identify the assailant by rendering him or her harmless and very easy to apprehend, the indelible ink would, of course, leave a permanent mark for later identification, should the assailant escape. It is to this end that the medicated artificial fingernail 15 becomes, in effect, a self-protective device against an assailant and with more effect and easier operation than that of the aerosol Mace mist.

Figure 4:
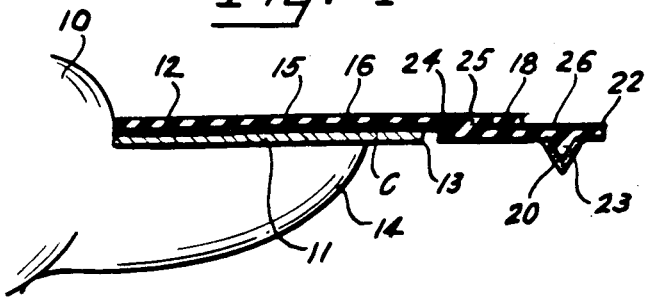
FIG. 4 is a side elevation, partially in section, of a fingertip showing an artificial nail secured to the exposed portion of the natural nail and a member provided with a prong that is secured to the underside of the artificial nail.
Figure 5:
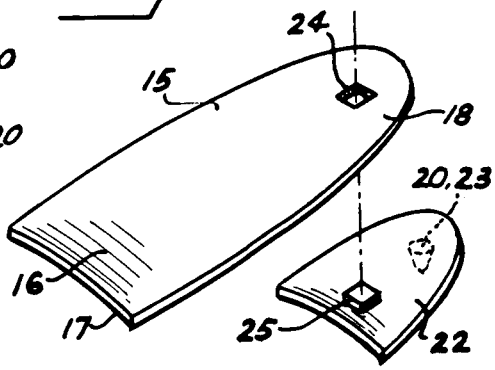
FIG. 5 is a perspective view of the artificial nail shown in FIG. 4 and discloses means for securing and interlocking the member and the artificial nail.

In another embodiment as seen in FIGS. 4 and 5, the natural nail 11 on the fingertip 10 also has an end 13 extending beyond the end 14 of the fingertip. The artificial nail 15 is secured to the natural nail 11 in the same manner as described above. In this embodiment, a separate member 22 having an extending prong 23 is secured to the underside 17 of the extending portion 18. In order to add additional strength to this structure, the artificial nail 15 is provided with a polygonal aperture 24 for receiving a conforming shaped lug 25 that is integral with the upper surface 26 of the member 22. In this embodiment, the member 22 is curved and shaped to conform to the upper and under surfaces 16 and 17 of the artificial nail 15 and is, of course, secured to the artificial nail 15 in the same manner as the artificial nail is secured to the natural nail 11 in the embodiment previously described. This structure is used in the same manner as described above and is merely another form of the same self-protective device.

Figure 6:
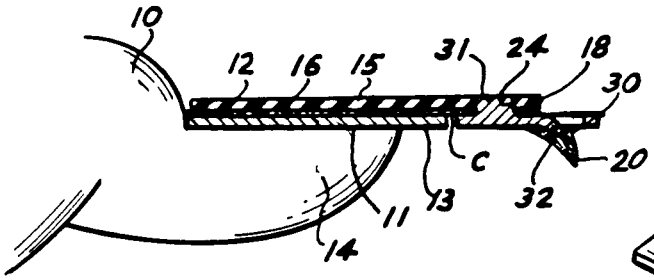
FIG. 6 is a side elevation, partially in section, of a fingertip showing an artificial nail secured to the exposed surface of the natural nail and a metallic member provided with a formed prong securable to the underside of the artificial nails.
Figure 7:
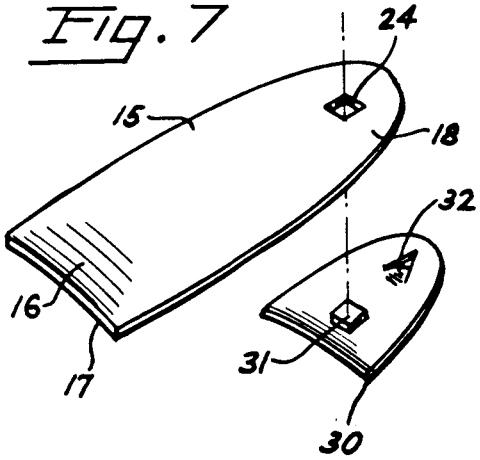
FIG. 7 is a perspective view of the artificial nail shown in FIG. 6 disclosing means for securing and interlocking the member and the artificial nail.

The artificial nail 15 as shown in FIGS. 6 and 7 is similar to the structure shown in FIGS. 4 and 5. A member 30 is formed of a thin metal with a plug 31 stamped in a corresponding shape for engaging the aperture 24 in the artificial nail 15. A prong 32 is formed in a direction to extend outward so as to assume the same relative position as the prong 19 or 23 as disclosed with respect to the aforementioned embodiments.

While the artificial nail 15 is generally accepted as being formed or molded from a plastic material, it can also be made of thin metal and formed to a predesignated shape. Such a metallic artificial nail would provide more strength and rigidity than the plastic nail and, if such nails are provided in sets, needs to be only a single nail in a set of this type.

Figure 8:
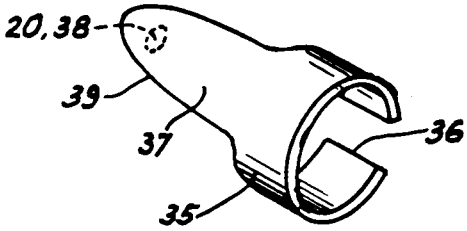
FIG. 8 is a perspective view of another embodiment of the invention showing a split ring having an extension simulating a fingernail with a prong protruding from the under side of the extension.

In some instances, such as by an elderly person, male or female, or by a male person, the use of artificial fingernails may be thought to be replusive. Also, the use of gloves prevents an effectual use of artificial nails. Accordingly, another embodiment of the invention is disclosed in FIG. 8 in which a member 35 is shaped in the form of a ring having a slot or slit 36 and an extension 37 curved and formed to simulate a fingernail. The extension 37 is provided with a prong 38 pressed or cut to extend below the under surface 39 in the same manner as prongs 23 and 32 in the above-described embodiments, the extension 37 serving, in effect, as an artificial nail. The slot 36 permits the diameter of the ring to be adjusted in size to a finger or a gloved finger without affecting the operation of the device as described above.

Several structures are disclosed and described hereinabove for adapting an extending prong structure to a finger or an artificial nail. Also, there are many substances that can be used to serve as an identifying substance; for example, an indelible ink, a tranquilizer, a substance that will produce a burning or itching sensation, or the like. Also, in the event the device is used, it should be immediately disposed of to eliminate any possible virus contamination. When not in use, the device should be stored in a closed container as a precautionary matter.

Accordingly the invention has been described in detail with particular reference to preferred embodiments thereof but it will be understood that various changes and modifications can be effected within the spirit of the invention.

I claim:

1. A device releasably secured to a natural nail on a finger of a user for self-protection against an assailant, comprising:

an artificial nail releasably secured to the natural nail having a convex upper surface and a concave under surface conforming generally to the exposed surface of the natural nail, a portion thereof extending beyond the outer end of the finger and of the natural nail; and means arranged on the under surface of the extending portion for penetrating the skin of the assailant when in contact with the skin and sufficient pressure is applied by the finger to the device and for carrying a substance introduceable into the blood stream of the assailant to subsequently identify the assailant.

2. A device releasably secured to a natural nail on a finger of a user in accordance with claim 1 wherein the penetrating means is a sharp prong integral with the artificial nail, arranged and protruding from the under surface of the extending portion thereof and carrying the substance.

3. A device releasably secured to a natural nail on a finger of a user in accordance with claim 3 wherein the penetrating means comprises a member securable to the under surface of the extending portion of the artificial nail and having a sharp prong for penetrating the skin of the assailant to introduce the substance into the blood stream of the assailant.

4. A device releasably secured to a natural nail on a finger of a user in accordance with claim 3 wherein the member is mechanically secured to the artificial nail by fastening means to alleviate loss of the member with the pressure applied by the finger.

* * * * *